US006089247A

United States Patent [19]

Price

[11] Patent Number: 6,089,247

[45] Date of Patent: Jul. 18, 2000

[54] COLLAPSIBLE FRAME

[76] Inventor: Walter L. Price, 1229 E. Gary Cir., Mesa, Ariz. 85203

[21] Appl. No.: 09/132,817

[22] Filed: Aug. 12, 1998

[51] Int. Cl.[7] ..... E04H 15/50

[52] U.S. Cl. ..... 135/145; 135/151; 135/155

[58] Field of Search ..... 135/114, 139, 135/140, 141, 142, 143, 144, 151, 145, 155, 147; 403/100, 101, 102

[56] References Cited

U.S. PATENT DOCUMENTS

| | | | |
|---|---|---|---|
| 957,215 | 5/1910 | Juin | 135/139 |
| 2,137,625 | 11/1938 | Norvell . | |
| 2,723,673 | 11/1955 | Call . | |
| 2,962,034 | 11/1960 | Finlayson . | |
| 3,266,503 | 8/1966 | Hoiness et al. . | |
| 3,810,482 | 5/1974 | Beavers . | |
| 4,066,089 | 1/1978 | Rainwater | 135/143 X |
| 4,074,682 | 2/1978 | Yoon . | |
| 4,285,354 | 8/1981 | Beavers . | |
| 4,558,713 | 12/1985 | Hagler et al. | 135/120.3 X |
| 4,947,884 | 8/1990 | Lynch | 135/145 X |
| 5,224,507 | 7/1993 | Vosse . | |
| 5,511,572 | 4/1996 | Carter . | |
| 5,577,799 | 11/1996 | St. Germain | 403/102 X |
| 5,632,293 | 5/1997 | Carter . | |
| 5,634,483 | 6/1997 | Gwin . | |
| 5,638,853 | 6/1997 | Tsai | 135/145 |
| 5,806,549 | 9/1998 | Love | 135/143 |

*Primary Examiner*—Richard Chilcot
*Attorney, Agent, or Firm*—Lewis, D'Amato, Brisbois & Bisgaard LLP

[57] ABSTRACT

A collapsible frame for use in erecting tents, insect screen rooms, shade awnings, canopies and the like at camp sights, back yard patios and other outdoor venues. The collapsible frame includes a plurality of telescopic legs for providing vertical structural support and a plurality of corner pin joints with one of the pin joints fixedly mounted upon a corresponding one of each of the telescopic legs. A plurality of horizontal support arms is included with one of the arms positioned between every adjacent pair of telescopic legs and attached to the corresponding corner pin joints. A mid-span hinge which includes a sliding sleeve is centrally positioned along each of the horizontal support arms. The mid-span hinge is flexibly collapsible when the sleeve is disengaged and is rigidly inflexible when the sleeve is engaged. A bottom slider is adjustably mounted upon each of the telescopic legs and is attached to the horizontal support arms which are connected to the corresponding corner pin joint. Finally, a plurality of top support members is included where each is anchored in a corresponding corner pin joint for stabilizing the frame. In the present invention, the telescopic legs, mid-span hinges and bottom sliders each cooperate to collapse the frame.

17 Claims, 5 Drawing Sheets

COLLAPSIBLE FRAME

BACKGROUND OF THE INVENTION

1. Field of the Invention

The present invention relates to the assembly and disassembly of temporary structures and other protective shelters typically in the out-of-doors. More specifically, the present invention relates to methods and apparatus for a collapsible frame for use in erecting tents, insect screen rooms, shade awnings, canopies and the like at camp sights, back yard patios and other outdoor venues.

2. Description of the Related Art

The relevant art is directed to collapsible frames utilized in erecting temporary structures for use in the out-of-doors. The typical frame apparatus of the prior art is employed as a temporary shelter or canopy or as a frame for a tent to serve various functions in the outdoors.

The outdoor venue in which the frame apparatus of the prior art is typically utilized varies widely. The outdoor venue can be a campsite for hunting, fishing, hiking, rock climbing, a roadside camping facility for recreational vehicles, an outdoor market where goods are offered for sale or any other outdoor activity typically removed from ones residence. In the alternative, the outdoor venue can be as local as a barbecue grill located at a city park, the beach or even on the patio or in the back yard of ones own residence.

Many of the collapsible frames of the prior art involve complicated articulated linkage which is difficult to manipulate. Additionally, many of the prior art frames are heavy and cumbersome to assemble and disassemble and thus are neither convenient nor desirable choices by persons of small physical stature. Another common problem relates to the frequent misplacing or loss of some of the plurality of component parts necessary for the assembly of the frame. As a result, certain components necessary to complete assembly of the frame may not be available and thus frustrates the effort to completely assemble of the frame.

Examples of the prior art include a frame apparatus employed as a collapsible shelter which includes a flexible collapsible canopy. The collapsible shelter includes a truss and canopy framework that enables the flexible, collapsible canopy to be moved between a raised position and a lowered position. The shelter includes at least three legs supporting flexible poles removably mounted to the tops of the legs and forming the framework of the canopy. X-shaped truss pairs of link members (known in the art as a scissors construction) are connected to each of the legs on each side of the shelter between adjacent legs. The scissors construction exhibits an articulated frame linkage of which the components must be accurately sized in order for the collapsible feature to be realized. This necessary standard of manufacturing accuracy adds to the production costs of the frame apparatus. Further, the scissors construction is difficult for small persons to manipulate.

Another example of a frame apparatus includes a tent structure which exhibits an elevated tent framework having a plurality of support legs and elevated rafters for supporting a tent canvas useful, for example, at a burial site. Yet another example is a framework having non-adjustable support legs driven into the ground for stability. Another example of a frame apparatus is disclosed in a geodesic dome shelter where the construction skeleton radiates outwardly from the apex portion of the shelter. Another example is a framework in which the skeleton provides a rectangular cage in which a canvas top is suspended. The framework is collapsible but each component of the cage must be manually disassembled.

A canopy support system is also disclosed which is intended to support the canopy portion of a self-contained collapsible canopy type tent. The support system includes a plurality of interconnected resilient cord elements extending from a central hub to multiple support frame attachment points around a collapsible metal frame of the tent. The resilient cords are adjustable for providing the required tension and provide intermediate canopy support between a central support pole and a perimeter support frame. Another example of a frame apparatus teaches a tent structure which includes four poles interconnected by four scissors-type linkages forming a square structure and four intermediate pivot connecting members.

Many other frame apparatuses are known in the prior art for providing an enclosure or canopy arrangement for the purpose of, for example, enclosing a utility manhole in the street or enclosing a public utilities crew in a work environment. Although these frame apparatuses are collapsible and lightweight, many lack the structural integrity necessary to endure continuous usage and the elements.

Thus, there is a need in the art for a collapsible frame that comprises a lightweight, simplified robust construction fashioned into a rigid frame, in which the support legs and upper support structure are permanently connected to minimize misplacing component parts, exhibits a means for conveniently adjusting the vertical height of the frame and disassembly of the horizontal frame members, and is easily manipulated by persons of small physical stature.

SUMMARY OF THE INVENTION

Briefly, and in general terms, the present invention provides a new and improved collapsible frame for use in erecting tents, insect screen rooms, shade awnings, canopies and the like in the out-of-doors such as camp sights, back yard patios and other outdoor venues. The novel and non-obvious collapsible frame exhibits a robust lightweight design including an aluminum frame, the stability of which increases as the weight load on the frame increases. The collapsible frame is assembled and disassembled quickly and easily since each of the component elements remains connected in the collapsed position. The height of the collapsible frame can be easily adjusted so that the superstructure provides adequate headroom for average height persons. When disassembled, the collapsible frame is transported and stored in a convenient carrying enclosure.

The present invention is generally directed to a collapsible frame for use in erecting tents, insect screen rooms, shade awnings, canopies and the like in the out-of-doors and typically employed at, for example, camp sights, roadside camping facilities for recreational vehicles, at a city park, the beach or even on the patio or in the back yard of a residence or other outdoor venue. In its most fundamental embodiment, the collapsible frame comprises a plurality of telescopic legs for providing vertical structural support and a plurality of corner pin joints with one of the pin joints fixedly mounted upon a corresponding one of each of the telescopic legs. A plurality of horizontal support arms is included with one of the arms positioned between every adjacent pair of telescopic legs and attached to the corresponding corner pin joints. A mid-span hinge which includes a sliding sleeve is centrally positioned along each of the horizontal support arms. The mid-span hinge is flexibly collapsible when the sleeve is disengaged and is rigidly inflexible when the sleeve is engaged. A bottom slider is adjustably mounted upon each of the telescopic legs and is attached to the horizontal support arms which are connected to the corresponding corner pin joint. Finally, a plurality of top support members is included where each is anchored in a corresponding corner pin joint for stabilizing the frame. In the present invention, the telescopic legs, mid-span hinges and bottom sliders each cooperate to collapse the frame.

In a preferred embodiment, the collapsible frame includes a stabilizing foot mounted on the bottom of each of the telescopic legs for increasing the stability of the frame. The upward facing ends of each of the top support members are connected together in a four-hinge junction of a top center joint. Further, each of the top support members comprises two portions which are releasably connected by an elastic cord. Finally, each of the adjustable components of the collapsible frame employs either a V-shaped, spring-loaded push button for use with, for example, the telescopic legs or a cylindrical locking pin for use with, for example, the bottom slider for securely retaining the components together.

These and other objects and advantages of the present invention will become apparent from the following more detailed description, taken in conjunction with the accompanying drawings which illustrate the invention, by way of example.

DESCRIPTION OF THE INVENTION

Figure 1:
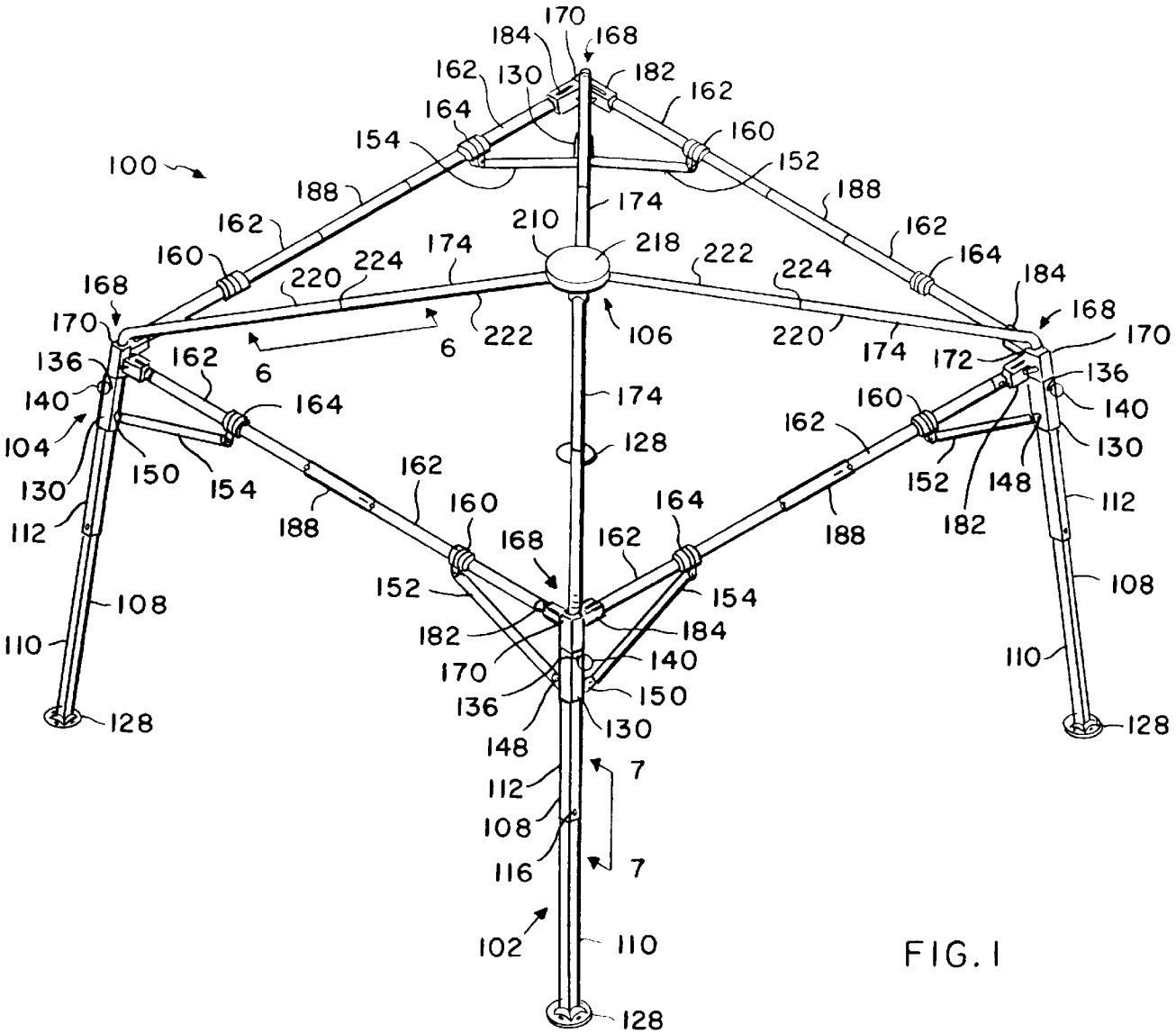
FIG. 1 is a top perspective view of a collapsible frame of the present invention showing four telescopic legs supporting an upper support structure comprising a rectangular frame having four corner pin joints and four mid-span hinges employed to support a superstructure which intersects at a center joint.

The present invention is a collapsible frame 100 as best shown in FIG. 1 for use in erecting tents, insect screen rooms, shade awnings, canopies and the like typically in the out-of-doors. The collapsible frame 100 of the present invention serves as a support by providing a structure for attaching material components such as canvas, netting, screens, plastic and the like for erecting tents, screen rooms, awnings and canopies as desired. The collapsible frame 100 is typically employed at camp sights, roadside camping facilities for recreational vehicles, at a city park, the beach or even on the patio or in the back yard of a residence or other outdoor venue.

A preferred embodiment of the collapsible frame 100 is shown in FIGS. 1–9 and comprises three main categories which include a base portion 102, an upper support structure 104 and a superstructure 106. The base portion 102 includes a plurality of four telescopic legs 108 each having a lower leg portion 110 and an upper leg portion 112 as is shown in FIG. 1. The lower leg portion 110 telescopes upward into the interior of the upper leg portion 112. Thus, both the lower leg portion 110 and the upper leg portion 112 (and other components described hereinafter) adopt a square-shaped configuration as is shown in FIG. 1. It has been discovered that the square-shaped configuration glides easier and fits more securely providing a more stable structure.

Figure 7:
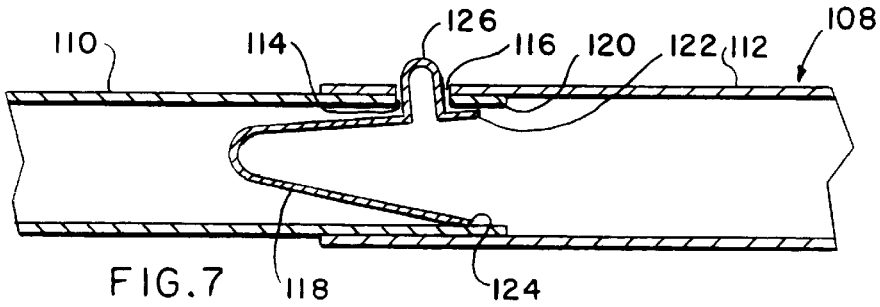
FIG. 7 is a cross-sectional view of a V-shaped, spring-loaded push button for use with the telescopic components of the collapsible frame taken along line 7—7 of FIG. 1 showing the V-shaped configuration.

The lower leg portion 110 includes a plurality of penetrations 114 formed therein. Likewise, the upper leg portion 112 includes at least one penetration 116 that can be manually aligned with any one of the penetrations 114 of the lower leg portion 110. In order to lock the lower leg portion 110 at a specific height with respect to the upper leg portion 112, a V-shaped, spring-loaded pushbutton 118 as shown in FIG. 7 is employed. The upper leg portion 112 is shown enveloping an end 120 of the lower leg portion 110 (where the two components of the telescopic leg 108 are illustrated in a horizontal view in FIG. 7 verses an upright view as shown in FIG. 1). The spring-loaded pushbutton 118 is V-shaped in configuration and is positioned inside the square construction of the lower leg portion 110. Each of the spring-loaded pushbuttons 118 includes a first end 122 and a second end 124 as shown in FIG. 7. The first and second ends 122 and 124, respectively, apply force to the inside surface of the square-shaped lower leg portion 110 by virtue of the spring tension associated with the V-shape of the spring-loaded pushbutton 118. This spring tension associated with the V-shape of the spring-loaded pushbutton 118 causes the pushbutton 118 to remain in position.

The side of the V-shaped, spring-loaded pushbutton 118 associated with the first end 122 thereof includes a bump or rise 126 that serves as a button. The bump or rise 126 extends through both the walls of the lower leg portion 110 and the upper leg portion 112 as shown in FIG. 7. During adjustment of the telescopic legs 108, the bump or rise 126 is manually depressed sufficiently far enough to pass the square configuration of the upper leg portion 112 but not the square configuration of the lower leg portion 110. Under these conditions, the lower leg portion 110 is free to glide within the square confines the upper leg portion 112. Once the lower leg portion 110 has been manually adjusted, the penetration 116 of the upper leg portion 112 is aligned with the selected one of the penetrations 114 of the lower leg portion 110. Because of the spring tension in the V-shaped, spring-loaded pushbutton 118, the bump or rise 126 will be forced through the aligned penetrations 114 and 116, respectively. The lower leg portion 110 is then locked into position with respect to the upper leg portion 112 and the adjustment of the telescopic leg 108 is complete.

The plurality of telescopic legs 108 are set at an angle of approximately 8° to a perpendicular vertical. Stated another way, the angle that the top of each telescopic leg 108 makes with the upper support structure 104 is slightly greater than a right angle, i.e., an obtuse angle. This construction is best shown in FIG. 1. The construction causes the base portion 102 of the collapsible frame 100 to be wider and thus to exhibit greater stability. To further improve the stability of the base portion 102, the bottom of the lower leg portion 110 of each of the telescopic legs 108 includes a stabilizing foot 128. The stabilizing foot 128 is positioned at a suitable angle and serves to provide greater footing of the base portion 102 thus increasing the stability of the collapsible frame 100.

Figure 2:
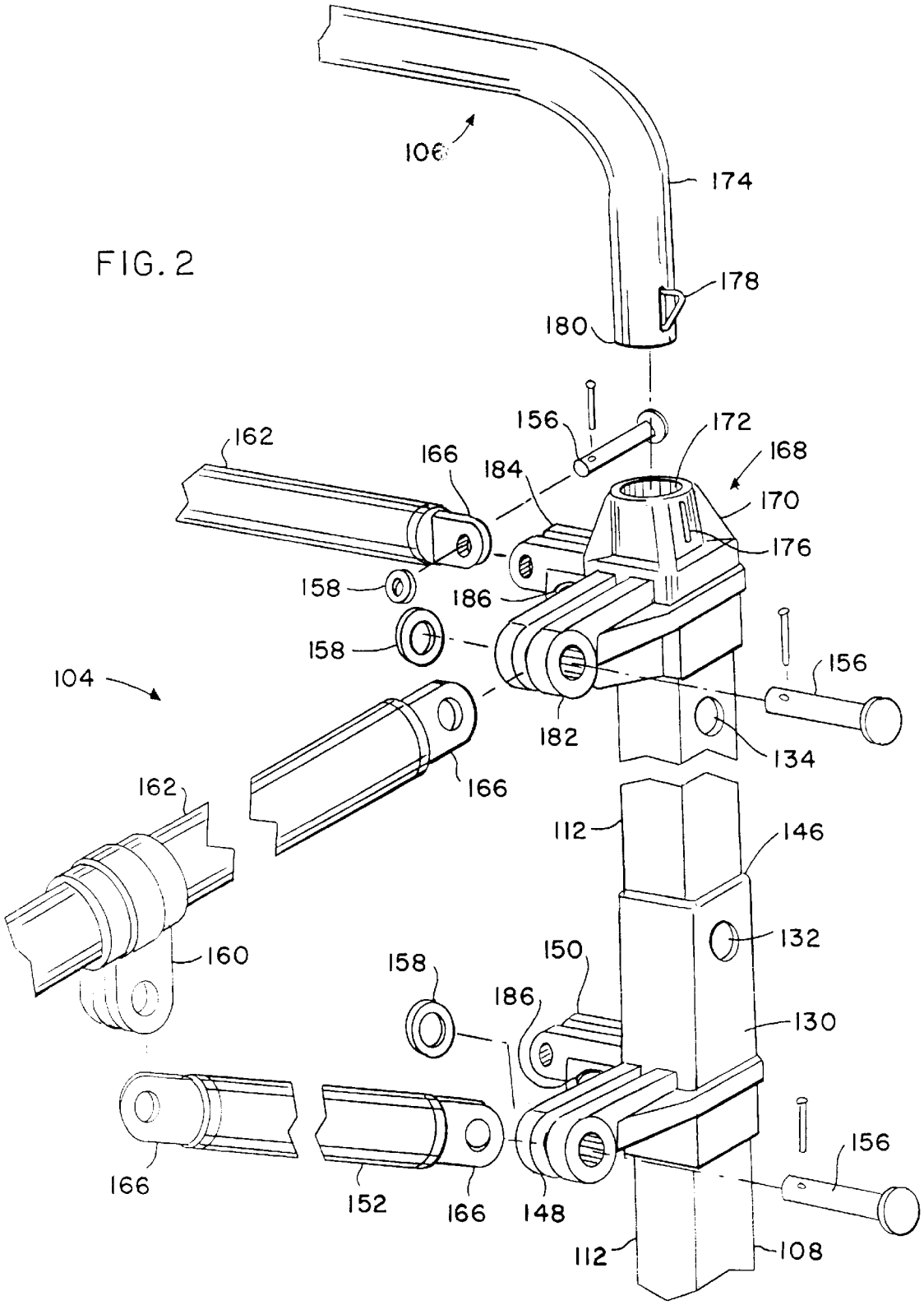
FIG. 2 is an exploded detail view of a pin joint of the collapsible frame of FIG. 1 showing the relationship between the square telescopic leg, corresponding cap and bottom slider, horizontal support arms and angular support arm.
Figure 9:
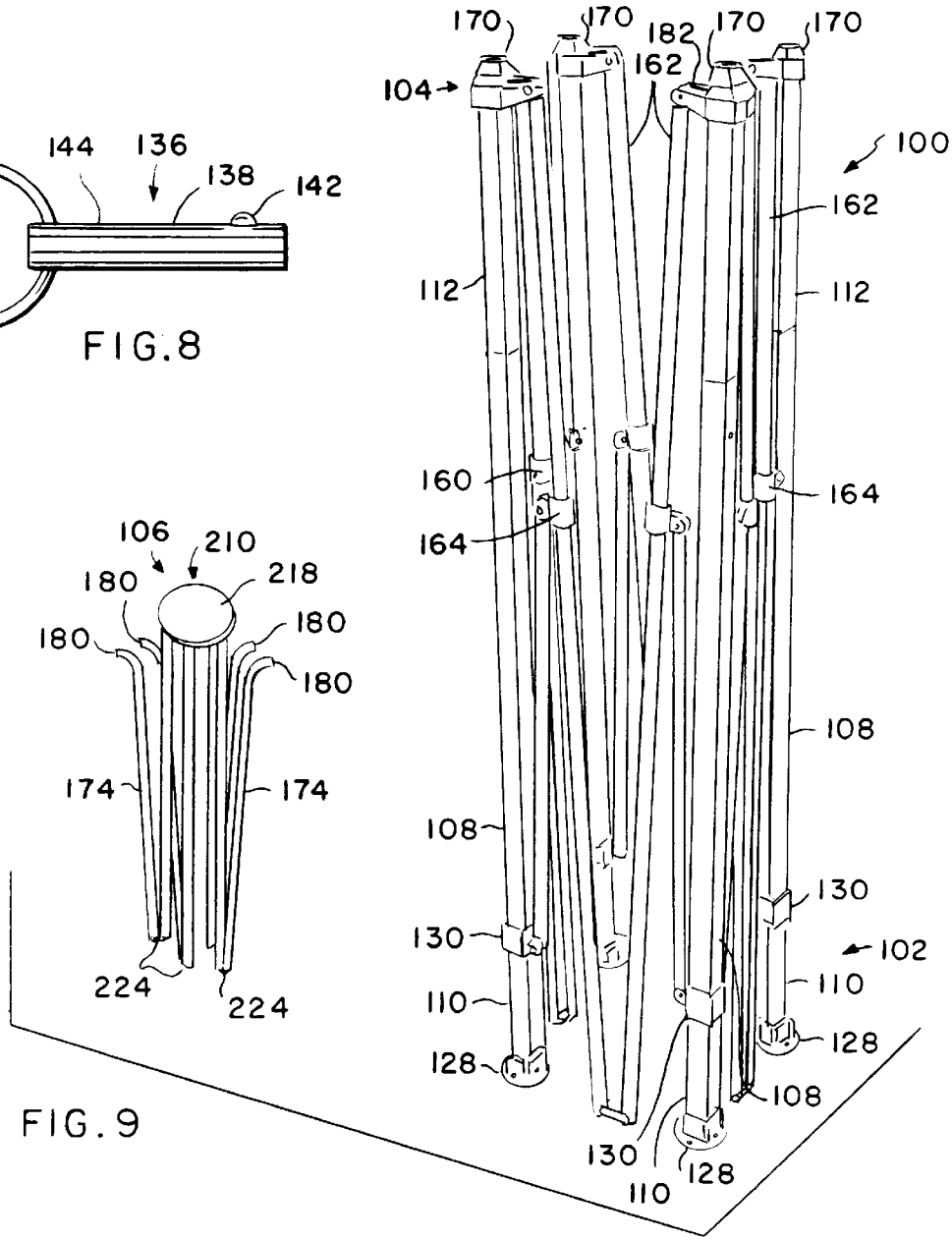
FIG. 9 is a perspective view of the collapsible frame of FIG. 1 shown in the collapsed position in preparation of insertion into a carrying case.

The upper support structure 104 which contributes to the support and collapsibility of the frame 100 includes the following components. Mounted upon each of the square-shaped telescopic legs 108 is a bottom slider 130 best shown in FIGS. 1 and 2. Each of the bottom sliders 130 is adjustably movable along the corresponding telescopic leg 108. The movable feature is illustrated in FIGS. 1 and 2 where the bottom slider 130 is shown mounted over the upper leg portion 112 of the telescopic legs 108. However, the collapsed position of the collapsible frame 100 illustrated in FIG. 9 shows the bottom slider 130 mounted over the lower leg portion 110 of the telescopic legs 108. It is this movable feature of the bottom slider 130 in combination with other components described hereinbelow that enable the frame 100 to assume a collapsed position that is very convenient for storage and portability.

Referring to FIG. 2, the bottom slider 130 is shown positioned on the upper leg portion 112 of the square telescopic leg 108. The bottom slider 130 is square-shaped and includes a penetration 132 located in the upper portion thereof. The penetration 132 can be aligned with another penetration 134 located at the upper end of the upper leg portion 112 as shown in FIG. 2. Once aligned, a cylindrical locking pin 136 can be utilized to lock the bottom slider 130 to the upper leg portion 112 by inserting the locking pin 136 through the aligned penetrations 132 and 134, respectively. Likewise, the bottom slider 130 can be unlocked to enable it to be moved along the corresponding telescopic leg 108 by withdrawing the cylindrical locking pin 136 from the aligned penetrations 132 and 134. The penetration 132 is positioned close to the top of the bottom slider 130 so as not to interfere with the full collapsing nature of the telescopic legs 108. The preferred embodiment discloses the use of both the V-shaped, spring-loaded pushbutton 118 and the cylindrical locking pin 136 to lock adjustable components of the present invention. It should be noted that the design of the present invention is sufficiently flexible to enable the use of either of these locking means or an equivalent thereto in the telescopic legs 108 and the bottom slider 130.

Figure 8:
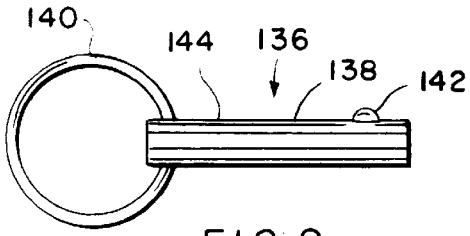
FIG. 8 is an elevation view of a cylindrical pin for use in locking the square-shaped telescopic legs in a selected position for adjusting the height of the collapsible frame and showing a spring-loaded ball locking arrangement incorporated within the cylindrical pin.

The cylindrical locking pin 136 utilized to lock the bottom slider 130 to the upper leg portion 112 of the telescopic leg 108 is shown in FIG. 8. The locking pin 136 comprises a cylindrical shaft 138 having a finger ring 140 passing through one end thereof. The finger ring 140 functions to enable easy manipulation and manual control of the locking pin 136 during use thereof. The cylindrical shaft 138 also includes a spring-loaded ball 142 which is mounted partially beneath the surface 144 of the shaft 138 so that the spring-loaded ball 142 extends above the surface 144 thereof. When the cylindrical locking pin 136 is inserted into the aligned penetrations 132 and 134 of the bottom slider 130 and the upper leg portion 112, respectively, the spring-loaded ball 142 is captured by the penetrations which retains the locking pin 136 in position. A sufficient pulling force applied on the finger ring 140 of the cylindrical locking ring 136 will force the spring-loaded ball 142 beneath the surface 144 of the cylindrical shaft 138. This action will release the locking ring 136 and enable the bottom slider 130 to be movably adjusted.

Referring once again to FIG. 2, the bottom slider 130 includes a fixed block 146 positioned at the top of the square-shaped slider 130 above the penetration 132. The fixed block 146 provides a minimum clearance space between the bottom slider 130 and the top of the telescopic leg 108. The bottom slider 130 also includes a first bracket 148 and a second bracket 150 each of which is integrally formed on one of two adjacent surfaces of the square-shaped bottom slider 130. Thus, the first bracket 148 is orthogonal to the second bracket 150 as is shown in FIG. 2.

Connected to each of the first bracket 148 and the second bracket 150 is one of a pair of angular support arms 152 and 154, respectively. Both angular support arms 152 and 154 are clearly shown in FIG. 1 but only angular support arm 152 is shown in the exploded view of FIG. 2. The angular support arm 152 is connected to the first bracket 148 and the angular support arm 154 is connected to the second bracket 150 via a mechanical fastener 156 such as, for example, a cotter pin and a washer 158 as shown in FIG. 2. The opposite end of the angular support arm 152 is connected to a first clamp 160 which is wrapped about and fixedly secured to a first of four horizontal support arms 162. Likewise, the angular support arm 154 is connected to a second clamp 164 which is wrapped about and fixedly secured to a second of the four horizontal support arms 162. All connections are accomplished with one of the mechanical fasteners 156 and washers 158. Each of the angular support arms 152 and 154 include terminal ends 166 comprised of a lightweight material such as polyvinylchloride (i.e., PVC) and having a penetration formed therein for the mechanical fasteners 156 as shown in FIG. 2.

The upper support structure 104 further includes a plurality of corner pin joints 168 as is clearly illustrated in FIG. 1. Each of the corner pin joints 168 includes a molded cap 170 that fits over the top edge of the corresponding upper leg portion 112 of the square-shaped telescopic leg 108 as is best shown in FIG. 2. The cap 170 is typically comprised of a high strength plastic and can be attached to the upper leg portion 112 by any suitable means such as an adhesive. The molded cap 170 also includes a cylindrical cavity 172 formed therein for receiving one of a plurality of top support members 174 of the superstructure 106. Each of the top support members 174 is typically round-shaped, comprised of aluminum and employed to stabilize the collapsible frame 100. Formed through the wall of the cylindrical cavity 172 of cap 170 is a slot 176 positioned to receive a spring-loaded wire protuberance 178 extending from the corresponding top support member 174.

The wire protuberance 178 is positioned within the top support member 174 and can include a construction similar to that shown in and discussed with respect to FIG. 7. However, the bump or rise 126 shown in FIG. 7 would be replaced with the wire protuberance 178. In the alternative, the wire protuberance 178 could be anchored in a coil spring (not shown) located within the top support member 174. Notwithstanding, the wire protuberance 178 is angled upward as is shown in FIG. 2 and thus will be depressed inward as the top support member 174 is inserted into the cylindrical cavity 172 of the cap 170. Upon reaching the slot 176, the wire protuberance 178 will spring out locking the top support member 174 into position. The top support member 174 can be released by applying pressure to the wire protuberance 178 and pulling upward on the top support member 174. In order to facilitate a snug fit in the cylindrical cavity 172, the round end 180 of each of the top support members 174 may be swedged.

Each of the corner pin joints 168 further includes a third bracket 182 and a fourth bracket 184. The bracket 182 and bracket 184 are essentially the same as the first bracket 148 and the second bracket 150 associated with the bottom slider 130. Thus, the third and fourth brackets 182 and 184 are each integrally formed on one of two adjacent surfaces of the square-shaped corner pin joint 168 so that the third bracket 182 is orthogonal to the fourth bracket 184 as is shown in FIG. 2. Connected to the third bracket 182 is the first of four of the horizontal support arms 162 and connected to the fourth bracket 184 is the second of the four horizontal support arms 162, respectively. Both of the first and second horizontal support arms 162 are clearly shown in FIG. 2 and each of the four horizontal support arms 162 are shown in FIG. 1. As with the first and second brackets 148 and 150 associated with the bottom slider 130, all connections are accomplished with one of the mechanical fasteners 156 (such as a cotter pin) and washers 158. Each of the horizontal support arms 162 include a terminal end 166 comprised of a lightweight material such as polyvinylchloride (i.e., PVC) and having a penetration formed therein for the mechanical fasteners 156 as shown in FIG. 2.

It is clear from the construction shown in FIGS. 1 and 2 that each of the four horizontal support arms 162 is connected to a corresponding corner pin joint 168 and to a corresponding bottom slider 130 via a corresponding angular support arm 152 or angular support arm 154. It is further noted that each corner pin joint 168 includes a penetration 186 formed in the web structure of the pin joint 168 (or other equivalent means) that is utilized to attach a tent fabric (not shown) thereto. The tent fabric (not shown) can be comprised of canvas, plastic or other suitable material which includes a means used to connect the tent fabric to the penetration 186 formed in the corner pin joint 168. Adding the tent fabric (not shown) to the structure further stabilizes the collapsible frame 100.

Figure 3:
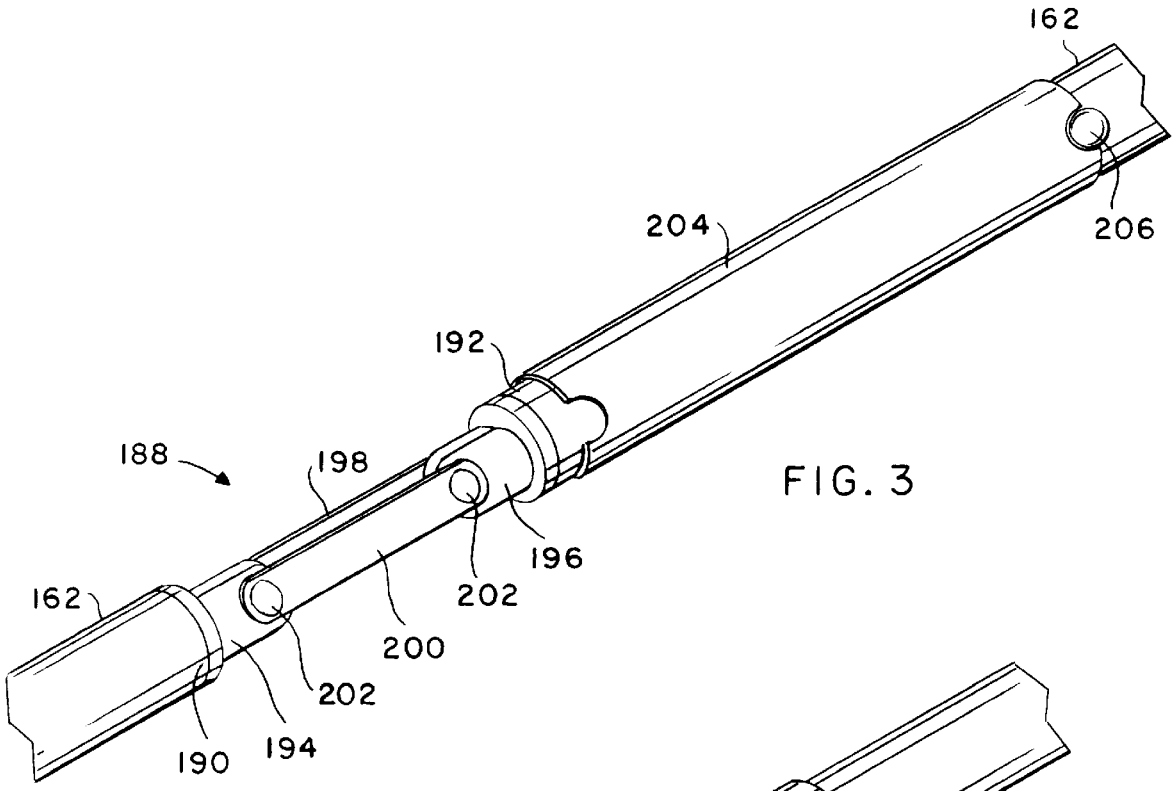
FIG. 3 is a detail view of the mid-span hinge of the collapsible frame of FIG. 1 shown with the movable sleeve in the disengaged position exposing the terminal ends of the adjacent horizontal support arms to facilitate collapsing of the frame.
Figure 4:
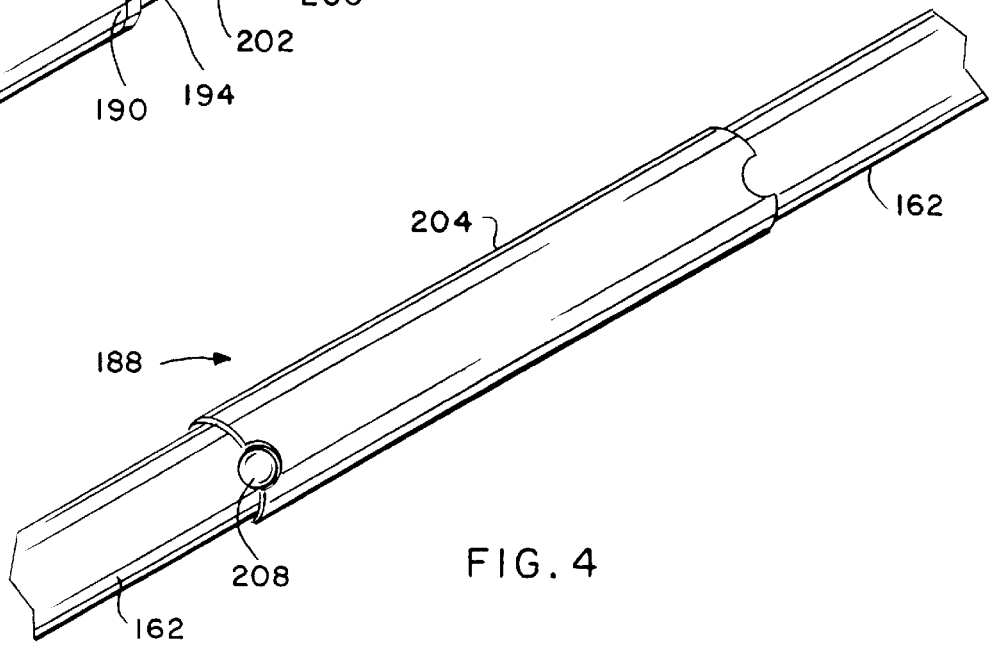
FIG. 4 is a detail view of the mid-span hinge of the collapsible frame of FIG. 1 shown with the movable sleeve in the engaged position surrounding the terminal ends of the adjacent horizontal support arms to facilitate structural integrity of the frame.

Centrally positioned along each of the four horizontal support arms 162 is a mid-span hinge 188 clearly shown in FIGS. 1, 3 and 4. Each of the four horizontal support arms 162 is circular and comprised of a lightweight material such as, for example, aluminum. The length of each of the four horizontal support arms 162 is interrupted approximately at the center of the span thereof forming two opposing, open-ended mid-span terminal ends 190 and 192 as shown in FIG. 3. Extending outward from each of the open-ended terminal ends 190 and 192 is a pair of connectors 194 and 196 having penetrations formed therethrough. Connectors 194 and 196 may be comprised of plastic having an outer surface which exhibits a low coefficient of friction such as Teflon.

Positioned between the pair of connectors 194 and 196 is a pair of parallel positioned plates 198 and 200 swivelly attached to the corresponding connectors 194 and 196, respectively, of each of the horizontal support arms 162. The parallel positioned plates 198 and 200 are attached to each of the corresponding connectors 194 and 196 as by, for example, use of a pair of rivets 202 through the penetrations formed in the connectors 194 and 196 as is shown in FIG. 3. Mounted over each of the horizontal support arms 162 and the mid-span hinge 188 is a sliding sleeve 204 shown in FIGS. 1, 3 and 4. The sliding sleeve 204 is cylindrical in shape and can be comprised of aluminum or a high strength plastic material such as polyvinylchloride (PVC). Further, the sliding sleeve 204 can have an inner surface (not shown) coated with a low friction material such as Teflon to minimize resistance to sliding.

In the view of FIG. 3, the sliding sleeve 204 is disengaged and the mid-span hinge 188 is exposed and capable of swivelling. Under these conditions, the mid-span hinge 188 is flexibly collapsible and cooperates with the telescopic legs 108 and the bottom slider 130 to enable the collapsible frame 100 to collapse into the reduced size posture as clearly shown in FIG. 9. Located on the surface of the horizontal support arm 162 is a first mechanical stop 206 as shown in FIG. 3. The first mechanical stop 206 serves to limit the travel of the sliding sleeve 204 away from the mid-span hinge 188. When the sliding sleeve 204 is engaged and thus positioned directly over the mid-span hinge 188 as shown in FIG. 4, the mid-span hinge 188 becomes rigidly inflexible and provides structural support to the corresponding horizontal support arm 162. A second mechanical stop 208 is positioned on the side opposite to the first mechanical stop 206 and serves to limit the travel of the sliding sleeve 204 in the opposite direction. It is noted that although the mid-span hinge 188 utilizes an interior hinge and an externally positioned sliding sleeve 204, other types of mid-span hinges that utilize an internal sliding device and an external hinge are also intended to be within the scope of the present invention.

Figure 5:
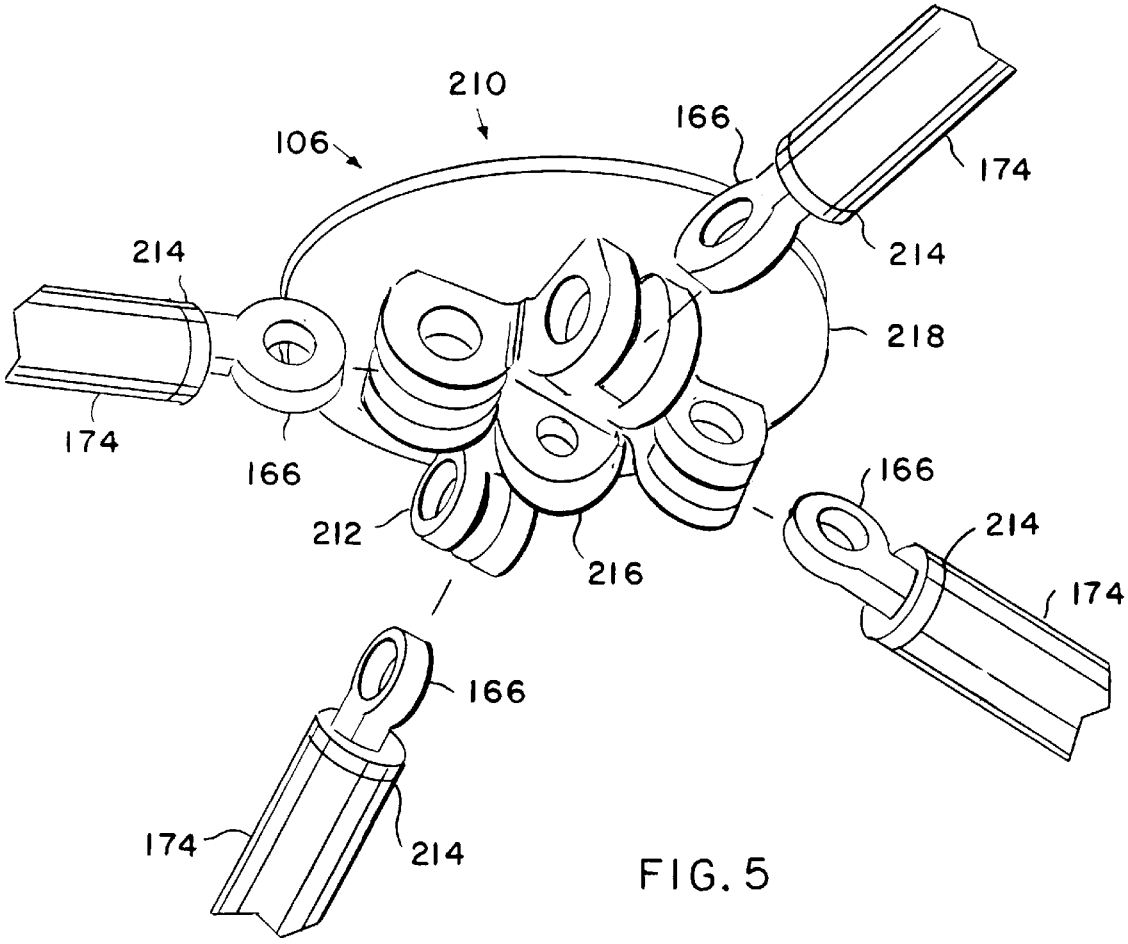
FIG. 5 is a bottom perspective view of a center joint of the superstructure of the collapsible frame of FIG. 1 showing a four hinge junction of the top support members.

The superstructure 106 of the collapsible frame 100 is shown in FIG. 1 and includes four of the top support members 174 (partially described during the discussion of FIG. 2), a top center joint 210, and a four-hinge junction 212. The superstructure 106 of the present invention serves to support the tent fabric, canopy, shade awning, screen room or other cover enclosure fabric. Each of the top support members 174 is anchored in the corresponding cylindrical cavity 172 of the corner pin joint 168 to stabilize the frame 100 as previously described and shown in FIG. 2. An end 214 opposite to the round end 180 of each top support member 174 (shown in FIG. 2) is inclined or upward facing as is illustrated in FIGS. 1 and 5. Each of the four upward facing ends 214 include a terminal end 166 having a penetration formed therethrough as is shown in FIG. 5. The terminal ends 166 can be duplicate to the terminal ends 166 utilized in conjunction with the bottom sliders 130 and corner pin joints 168 discussed and shown in FIG. 2.

The top center joint 210 includes the four-hinge junction 212 as shown in FIG. 5. The four-hinge junction 212 includes a structure very similar to the first bracket 148 and the second bracket 150 except that the four-hinge junction 212 comprises four separate hinges each orthogonal to the others. Each of the four hinges of the four-hinge junction 212 cooperates and receives one of the four terminal ends 166 of the corresponding top support member 174. As with the previous construction, a mechanical fastener 156 (such as a cotter pin) and washers 158 are utilized to connect each of the terminal ends 166 of the top support members 174 to the corresponding hinge of the four hinge junction 212. After the connections are complete, the round end 180 and the upward facing end 214 of each of the top support members 174 are anchored in the corner point joint 168 and the four-way hinge, respectively. The construction stabilizes each of the four corner pin joints 168 to add strength to the collapsible frame 100.

Mounted within the four-hinge junction 212 is an eyelet 216 as is shown in FIG. 5. The eyelet 216 serves as an anchor point for the tent fabric (not shown) that is attached to the inside of the collapsible frame 100 to form an enclosure. In addition, the eyelet 216 can be utilized to hang a lantern on the inside of the frame 100. Mounted over the top of the four-hinge junction 212 is a disk 218 which serves to improve the cosmetic appearance of the top center joint 210 by hiding the four-hinge junction 212 as is shown in FIGS. 1 and 5.

Figure 6:
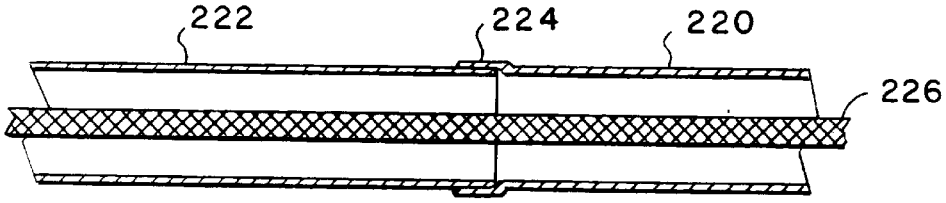
FIG. 6 is a cross-sectional view of a top support member of the superstructure of the collapsible frame taken along line 6—6 of FIG. 1 showing the elastic means by which the separate components of each top support member are secured together.

Each of the top support members 174 comprise two portions best shown in FIG. 6. An outer portion 220 is shown fitting over the end of an inner portion 222 at a lip 224. With this arrangement, the inner portion 222 can be separated from the outer portion 220 under pressure. Running the length through the interior of each of the top support members 174 is an elastic cord 226 as shown in FIG. 6. The elastic cord 226 can be connected on each of its ends to the interior of each of the top support members 174 in any suitable manner such as, for example, by tying. The function of the elastic cord 226 is to urge the mating of the outer portion 220 with the inner portion 222 of the top support member 174 while simultaneously enabling them to be separated. This design facilitates the collapsing of the superstructure 106 but also prevents the outer portion 220 from being separated from the inner portion 222.

FIG. 9 represents the collapsible frame 100 in the collapsed state. The base portion 102 and the upper support structure 104 are shown on the right side. However, the superstructure 106 shown on the left side of FIG. 9 is separate from the base portion 102 and upper support structure 104. Notwithstanding, each of the base portion 102, upper support structure 104 and superstructure 106 conveniently fit into a single carrying case for transporting the collapsible frame 100 to a camp sight or for storage.

During assembly, the collapsible frame 100 is removed from the carrying case (not shown) and the frame 100 is spread out on the ground. The frame 100 is lifted at the intersection of the upper support structure 104 and the telescopic legs 108. The bottom slider 130 is then adjusted as desired by utilizing the cylindrical locking pin 136. Next, the sliding sleeve 204 of the mid-span hinge 188 is engaged so that the frame 100 will stand upright. The superstructure 106 as shown in FIG. 9 is then unfolded and each of the top support members 174 is inserted into the cylindrical cavity 172 of the corner pin joints 168. At this time, the canopy (not shown) can be draped over the frame 100 and secured thereto and the tent fabric (not shown) can be attached to the inside of the frame 100. Thereafter, the height of the telescopic legs 108 can be adjusted as desired by depressing the bumps or rise 126 of the V-shaped, spring-loaded pushbutton 118 and moving the lower leg portion 110.

During disassembly, the canopy (not shown) and the tent fabric (not shown) are initially removed, if fitted. Thereafter, the superstructure 106 is disassembled by removing each of the top support members 174 from the cylindrical cavities 172 of the corresponding corner pin joints 168. Then, the sliding sleeve 204 is disengaged enabling the mid-span hinge 188 in each top support member 174 to be flexibly collapsible. The frame 100 will then collapse onto the ground. The cylindrical locking pin 136 is removed from each of the bottom sliders 130 and the telescopic legs 108 are released by depressing the bumps or rise 126 of the V-shaped, spring-loaded pushbuttons 118. The frame 100 is then manipulated into the collapsed tripod position. Finally, the collapsed frame 100 including the base portion 102, upper support structure 104 and superstructure 106 is inserted into the convenient carrying case (not shown).

The present invention provides novel advantages over other collapsible frame devices known in the art. The main advantages of the collapsible frame 100 include a robust lightweight design of aluminum that incorporates a mid-span hinge 188 that structurally supports the frame 100 when engaged and collapses when disassembled. The use of a single bottom slider 130 simplifies the design. The combination of the bottom slider 130, the mid-span hinge 188, the telescopic legs 108 and the removable superstructure 106 in combination enables a rapid and complete collapsing of the frame 100. Likewise, the assembly of the collapsible frame 100 is quick and convenient. Further, the collapsible frame 100 is assembled and disassembled quickly and easily since tools are not required. When disassembled, the collapsible frame 100 is transported and stored in a convenient carrying case (not shown).

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

It is therefore intended by the appended claims to cover any and all such modifications, applications and embodiments within the scope of the present invention. Accordingly,

What is claimed is:

1. A collapsible frame comprising:

a plurality of telescopic legs for providing vertical structural support;

a plurality of corner pin joints with one of said pin joints fixedly mounted on a top edge of and being distinctly separable from a corresponding one of each of said telescopic legs, each of said corner pin joints having a molded cap with a cylindrical cavity formed therein and a pair of orthogonally-positioned brackets extending from each of said corner pin joints;

a plurality of horizontal support arms with one of said arms positioned between every adjacent pair of telescopic legs and attached to said orthogonally-positioned brackets extending from the corresponding one of said corner pin joints;

a mid-span hinge centrally positioned along each of said horizontal support arms and including a sliding sleeve, said mid-span hinge comprising a pair of parallel positioned plates swivelly attached to a pair of mid-span terminal ends of each of said horizontal support arms and being flexibly collapsible when said sleeve is disengaged and being rigidly inflexible when said sleeve is engaged enclosing said parallel positioned plates;

a bottom slider adjustably mounted upon each of said telescopic legs and attached to the horizontal support arms connected to the corresponding one of said corner pin joints; and a plurality of top support members each lockably anchored in and releasable from said cylindrical cavity of a corresponding one of said corner pin joints for stabilizing said frame, wherein each telescopic leg, mid-span hinge and bottom slider cooperate to collapse said frame.

2. The collapsible frame of claim 1 wherein said frame is comprised of aluminum.

3. The collapsible frame of claim 1 wherein said frame is rectangular in shape.

4. The collapsible frame of claim 1 wherein each of said telescopic legs is rectangular in shape.

5. The collapsible frame of claim 1 wherein each of said telescopic legs includes a stabilizing foot for increasing the stability of said frame.

6. The collapsible frame of claim 1 wherein each of said telescoping legs includes a plurality of keyholes for receiving a cylindrical locking pin for adjusting the position of said bottom slider.

7. The collapsible frame of claim 1 wherein each of said horizontal support arms is attached to the corresponding pin joints by a mechanical fastener.

8. The collapsible frame of claim 1 wherein each of said bottom sliders is rectangular in shape.

9. The collapsible frame of claim 1 wherein each of said bottom sliders is attached to the corresponding horizontal support arm by one of a plurality of angular support arms.

10. The collapsible frame of claim 9 wherein each of said angular support arms is fixedly attached to the corresponding horizontal support arm.

11. The collapsible frame of claim 1 wherein each of said top support members comprises two portions releasably connected by an elastic cord.

12. The collapsible frame of claim 1 further including a top center joint for connecting together a plurality of upward facing ends of each of said top support members.

13. The collapsible frame of claim 12 wherein said top center joint further includes a multiple-hinge junction for connecting together said upward facing ends of each of said top support members.

14. The collapsible frame of claim 12 wherein said top center joint further includes a top disk for covering said joint.

15. The collapsible frame of claim 1 wherein each of said horizontal support arms further includes a pair of mechanical stops to limit the travel of said sliding sleeve of said mid-span hinge.

16. The collapsible frame of claim 1 wherein each of said telescopic legs further includes a V-shaped, spring-loaded push button mounted within and used for adjusting the length of said telescopic leg.

17. A collapsible frame for forming a shelter comprising:

a plurality of square telescopic legs for providing vertical structural support wherein each of said square telescopic legs includes a stabilizing foot;

a plurality of corner pin joints with one of said pin joints fixedly mounted on a top edge of and being distinctly separable from a corresponding one of each of said square telescopic legs, each of said corner pin joints having a molded cap with a cylindrical cavity formed therein and a pair of orthogonally-positioned brackets extending from each of said corner pin joints;

a plurality of horizontal support arms with one of said arms positioned between every adjacent pair of square telescopic legs and attached to said orthogonally-positioned brackets extending from the corresponding one of said corner pin joints;

a mid-span hinge centrally positioned along each of said horizontal support arms and including a sliding sleeve, said mid-span hinge comprising a pair of parallel positioned plates swivelly attached to a pair of mid-span terminal ends of each of said horizontal support arms and being flexibly collapsible when said sleeve is disengaged and being rigidly inflexible when said sleeve is engaged enclosing said parallel positioned plates;

a bottom slider adjustably mounted upon each of said square telescopic legs and attached to the horizontal support arms connected to the corresponding one of said corner pin joints by one of a plurality of angular support arms; and a plurality of top support members each lockably anchored in and releasable from said cylindrical cavity of a corresponding one of said corner pin joints for stabilizing said frame, wherein each square telescopic leg, mid-span hinge and bottom slider cooperate to collapse said frame.

* * * * *